US009718184B2

(12) United States Patent
Lee

(10) Patent No.: US 9,718,184 B2
(45) Date of Patent: Aug. 1, 2017

(54) TOOL BOX HOLDING ACCESSIBLE BUT NOT REMOVABLE TOOL WHEN CLOSED

(71) Applicant: Wen-Hsiung Lee, Taichung (TW)

(72) Inventor: Wen-Hsiung Lee, Taichung (TW)

( * ) Notice: Subject to any disclaimer, the term of this patent is extended or adjusted under 35 U.S.C. 154(b) by 116 days.

(21) Appl. No.: 14/833,162

(22) Filed: Aug. 24, 2015

(65) Prior Publication Data

US 2017/0057078 A1 Mar. 2, 2017

(51) Int. Cl.
*B25H 3/02* (2006.01)

(52) U.S. Cl.
CPC ..... *B25H 3/02* (2013.01)

(58) Field of Classification Search
CPC . B25H 3/003; B25H 3/02; B25H 3/06; B65D 25/22; B65D 85/20; B65D 85/28; F21V 33/00; F21V 33/0084
USPC ..... 206/349, 372–379
See application file for complete search history.

(56) References Cited

U.S. PATENT DOCUMENTS 5,975,297 A * 11/1999 Kao ..... B25B 13/56 206/378
6,523,687 B2 * 2/2003 Ling ..... B25H 3/02 206/373
7,225,923 B2 * 6/2007 Hallee ..... B25H 3/003 206/373
8,317,021 B2 * 11/2012 Christopher ..... B25H 3/003 206/234
2004/0084342 A1 * 5/2004 Chang ..... B25H 3/02 206/378

FOREIGN PATENT DOCUMENTS

CH GB 2522202 A * 7/2015 ..... B25H 3/003

* cited by examiner

*Primary Examiner* — Bryon Gehman
(74) *Attorney, Agent, or Firm* — Alan D. Kamrath; Kamrath IP Lawfirm, P.A.

(57) ABSTRACT

A tool box contains a body, at least one cover, and at least one fixer. The body includes at least one first accommodating portion for accommodating plural first tools and includes at least one display zone in which at least one holding portion is defined to hold at least one second tool. The at least one fixer is disposed in the at least one display zone of the body, and each of the at least one fixer includes at least one stopper to fix the at least one second tool in the at least one display zone. The at least one cover covers the body and includes at least one receiving groove formed therein and corresponding to the at least one display zone of the body to expose the at least one second tool in the at least one display zone of the body.

9 Claims, 10 Drawing Sheets

TOOL BOX HOLDING ACCESSIBLE BUT NOT REMOVABLE TOOL WHEN CLOSED

FIELD OF THE INVENTION

The present invention relates to a tool box in which at least one second tool is exposed in at least one display zone of a body by using at least one receiving groove of at least one cover, and at least one stopping portion of the at least one cover stops at least one fixer to avoid removal of the at least one second tool from the at least one display zone.

BACKGROUND OF THE INVENTION

Referring to FIGS. 1 and 3, a conventional tool box 10 contains a body 11 and a cover 12. The body 11 includes a plurality of accommodating recesses 111 to accommodate tools 13 of various types and sizes. The body 11 also includes two retainers 112 and a first grip bar 113 which are formed on a front end of the body 11. The cover 12 is rotatably connected with the body 11 and includes two fastening portions 121 disposed thereon to correspond to and retain with the two retainers 112 of the body 11. The cover 12 further includes a second grip bar 122 formed on a front end thereof to correspond to the first grip bar 113 of the body 11, and an indication paper 123 is adhered on a top surface of the cover 12 to indicate positioning locations and sizes of the tools. The cover 12 covers on the body 11, and the second grip bar 122 of the cover 12 contacts with the first grip bar 113 of the body 11, so that the tool box 10 is grasped by a user. The two retainers 112 of the body 11 retain with the two fastening portions 121 of the cover 12, and a plastic film covers the tool box 10 or two binders tie the two retainers 112, thus fixing the tool box 10. However, the tools of various types and sizes cannot be visible clearly.

The present invention has arisen to mitigate and/or obviate the afore-described disadvantages.

SUMMARY OF THE INVENTION

The primary objective of the present invention is to provide a tool box which contains a body, at least one fixer, and at least one cover. The body includes at least one first accommodating portion for accommodating plural first tools, and the body also includes at least one display zone in which at least one holding portion is defined to hold at least one second tool. The at least one cover is rotatably connected with the body and includes at least one receiving groove formed therein and corresponding to the at least one display zone of the body to expose the at least one second tool in the at least one display zone of the body.

Another objective of the present invention is to provide a tool box in which at least one fixer is disposed in the at least one display zone of the body, and each of the at least one fixer includes at least one stopper to fix the at least one second tool in the at least one display zone.

DETAILED DESCRIPTION OF THE PREFERRED EMBODIMENTS

Figure 1:
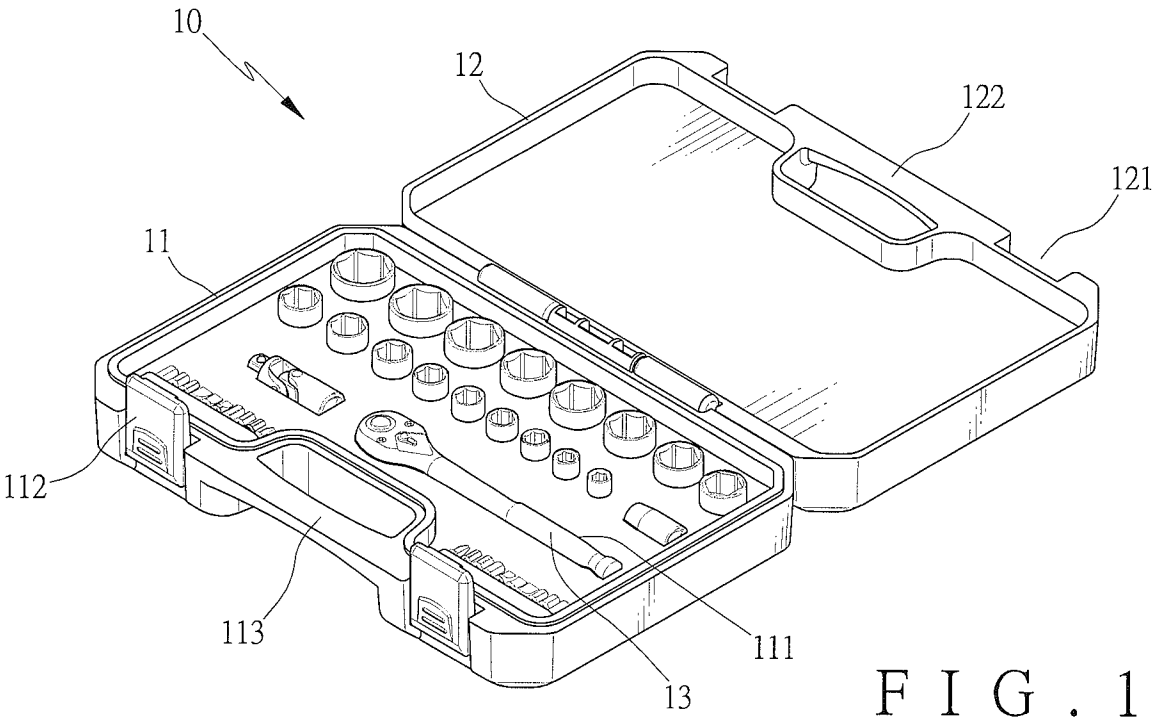
FIG. 1 PRIOR ART
FIG. 1 is a perspective view showing the assembly of a conventional tool box.
Figure 2:
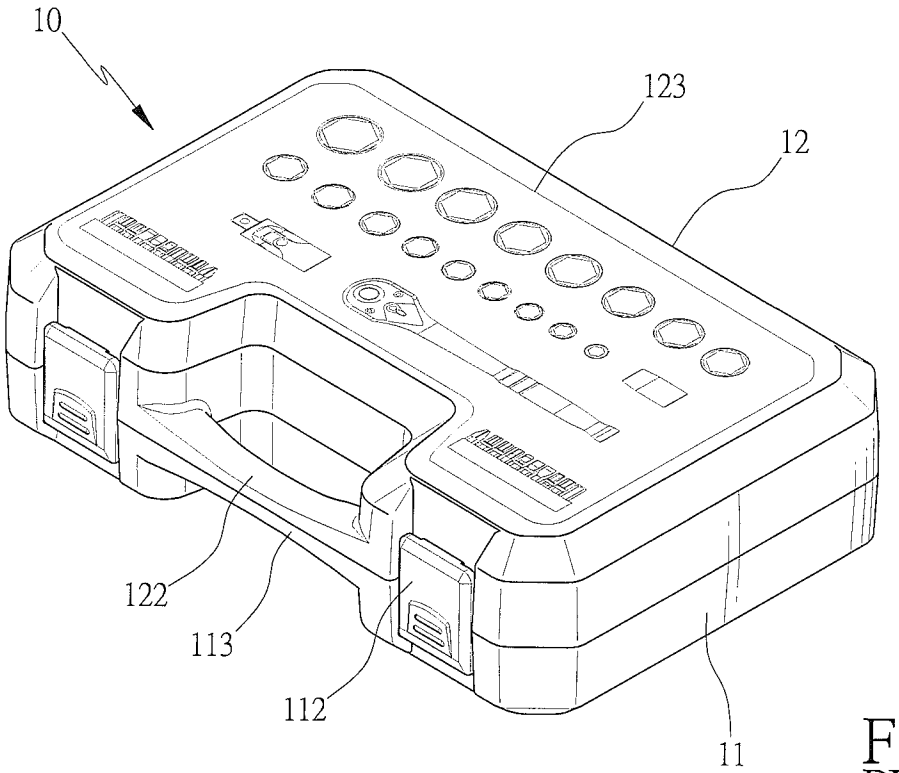
FIG. 2 PRIOR ART
FIG. 2 is a perspective view showing the application of the conventional tool box.
Figure 3:
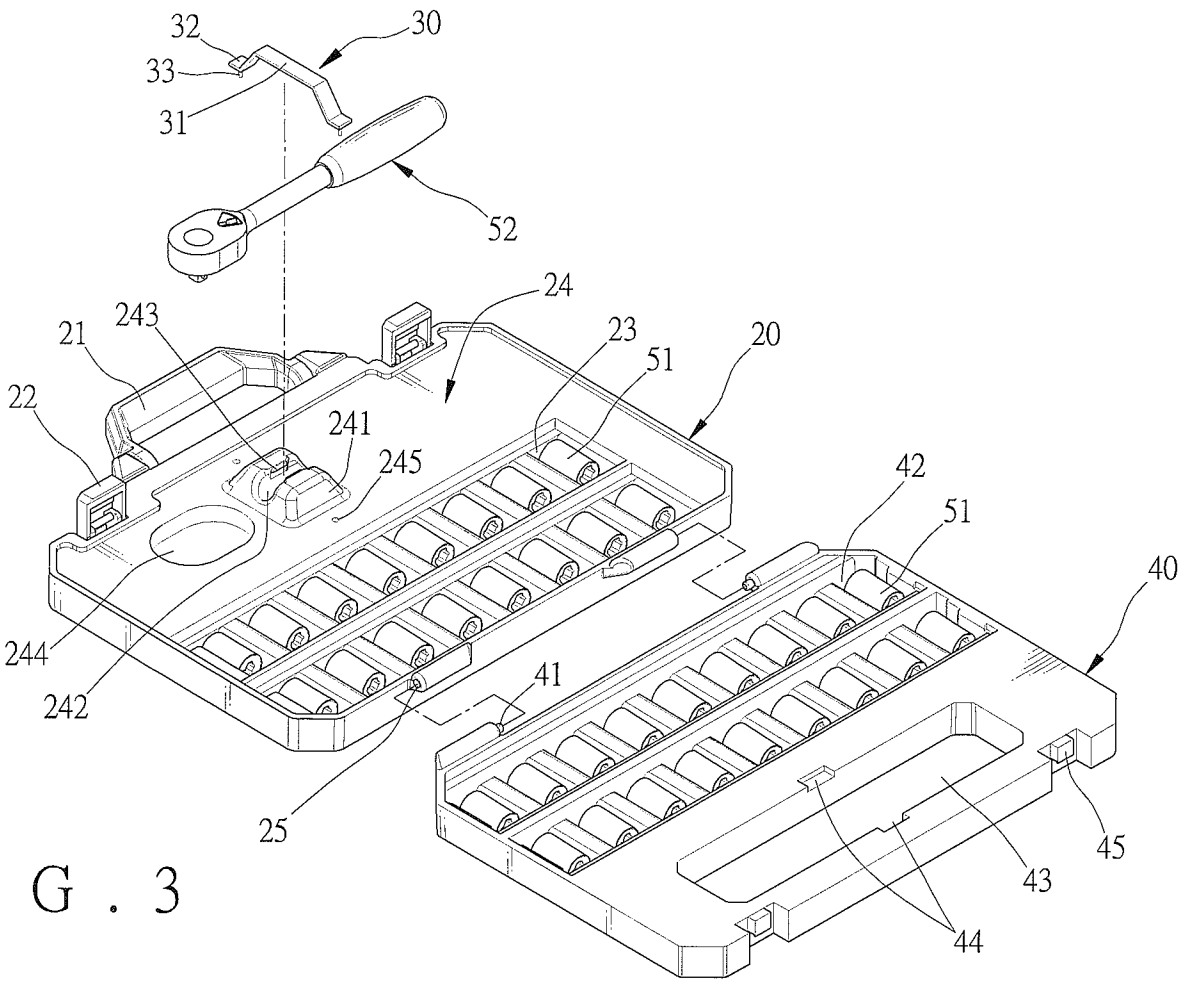
FIG. 3 is a perspective view showing the exploded components of a tool box according to a preferred embodiment of the present invention.
Figure 4:
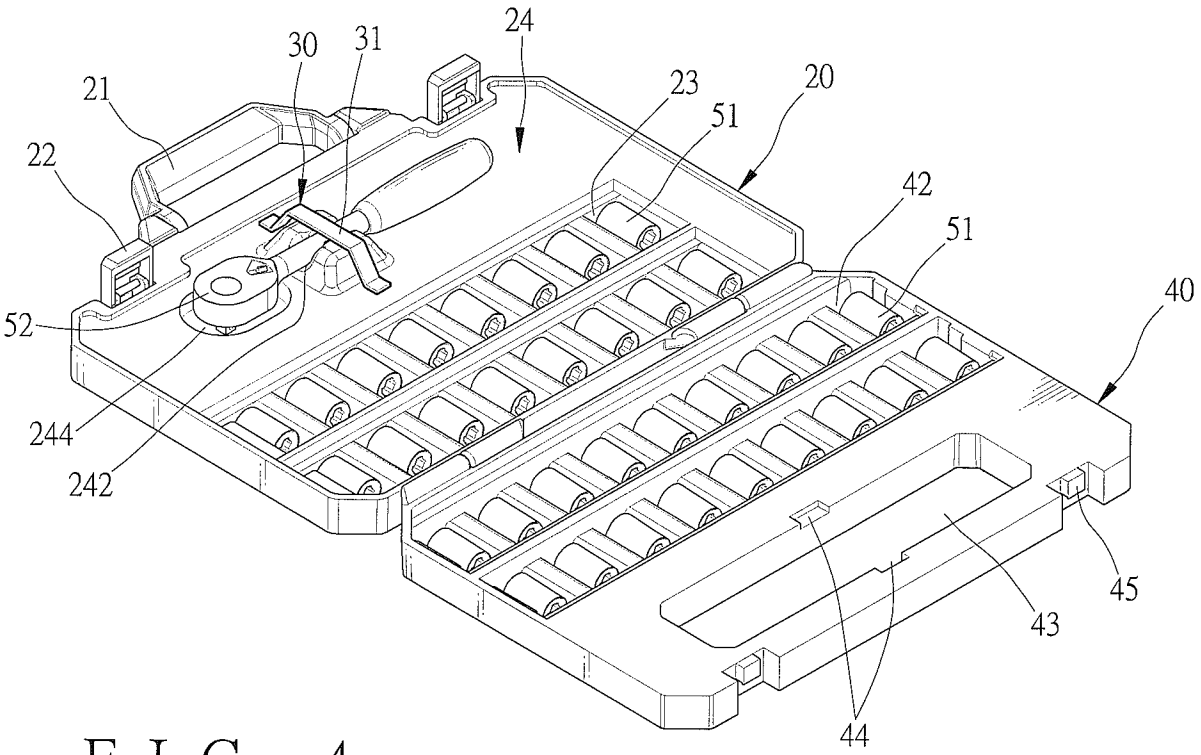
FIG. 4 is a perspective view showing the assembly of the box tool according to the preferred embodiment of the present invention.
Figure 5:
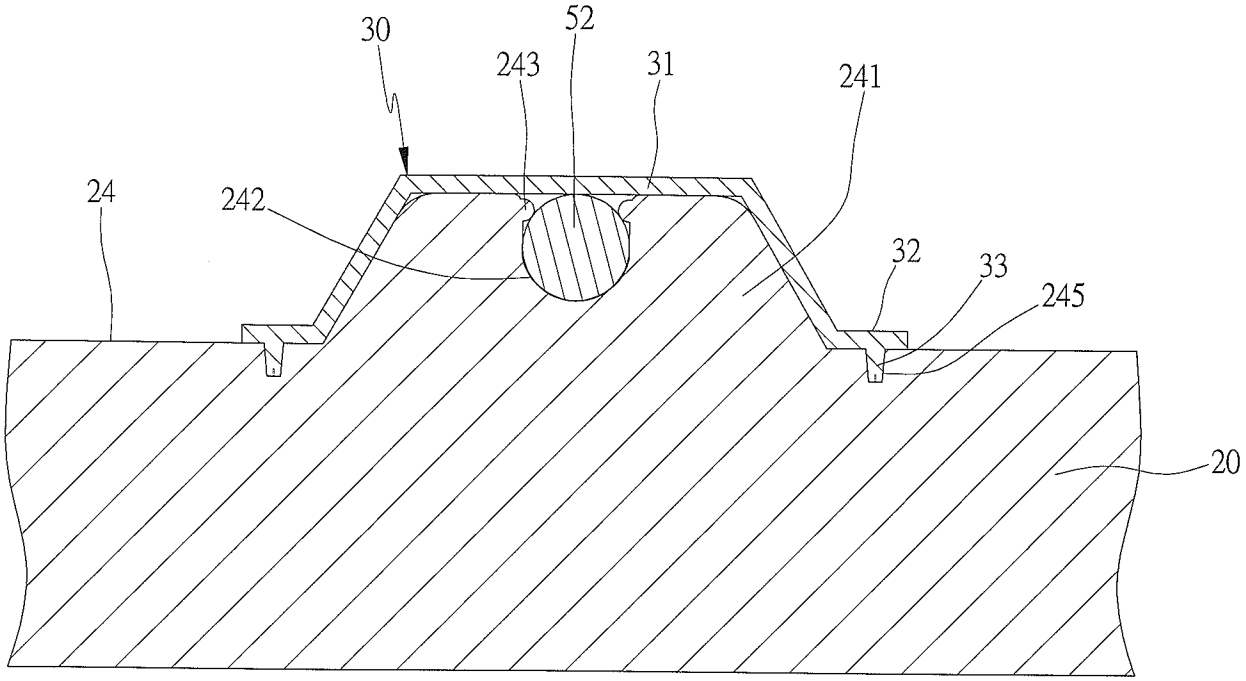
FIG. 5 is a cross sectional view of a part of FIG. 4.
Figure 6:
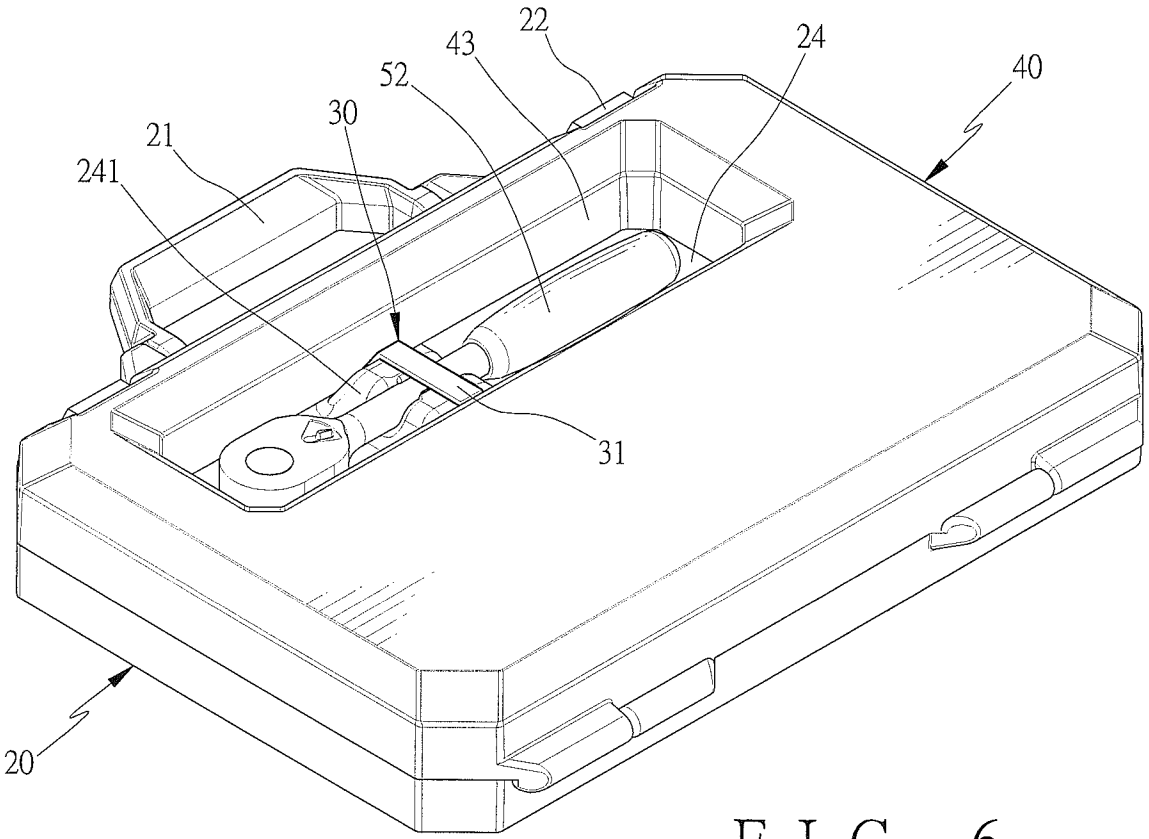
FIG. 6 is a perspective view showing the application of the box tool according to the preferred embodiment of the present invention.
Figure 7:
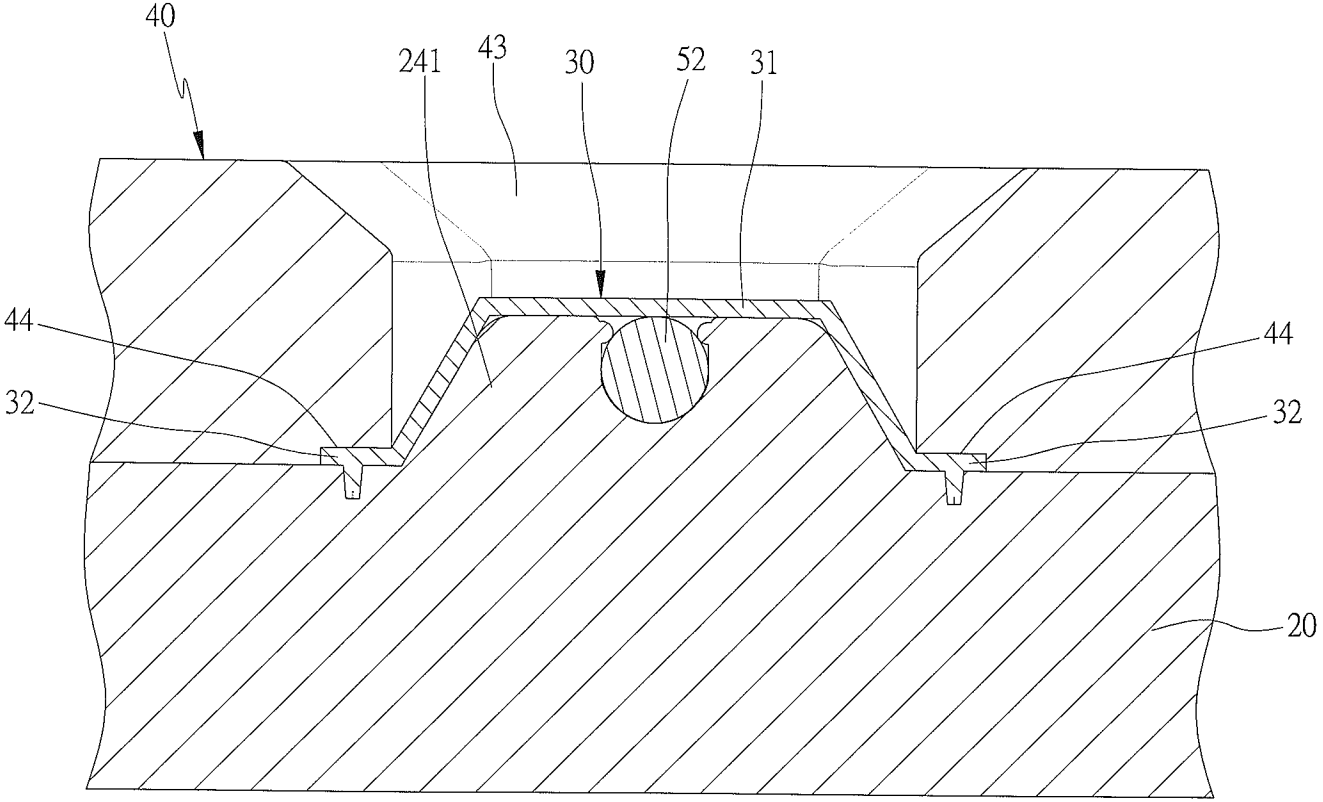
FIG. 7 is a cross sectional view of a part of FIG. 6.

With reference to FIGS. 3 to 5, a tool box according to a preferred embodiment of the present invention comprises: a body 20, at least one fixer 30, and at least one cover 40. The body 20 includes a grip bar 21 disposed on a first end thereof to be grasped by a user, two retainers 22, and at least one first accommodating portion for accommodating plural first tools. In this embodiment, the body 20 includes the plurality of first accommodating portions 23 for accommodating the plural first tools 51 (such as sockets).

The body 20 further includes at least one display zone 24 in which at least one holding portion is defined to hold at least one second tool 52. The at least one holding portion is a plane or a recess. In this embodiment, the at least one display zone 24 has a protrusion 241, a concave holding portion 242 defined on the protrusion 241 to hold a second tool 52 (such as a socket ratchet wrench), and two locking tabs 243. Each locking tab 243 is formed on each of two side walls of the concave holding portion 242 to retain the second tool 52, such that the second tool 52 is fixed in the concave holding portion 242 firmly. The at least one display zone 24 further includes a trench defined beside each of two sides of the concave holding portion 242 to accommodate at least one portion (such as a head portion, a gripping portion or a driving portion) of the second tool 52. In this embodiment, the at least one display zone 24 further includes the trench 244 defined beside each of two sides of the protrusion 241 to accommodate the head portion of the second tool 52.

Each of the at least one fixer 30 is disposed in the at least one display zone 24 of the body 20 and includes at least one stopper 31 to fix the second tool 52 in the at least one display zone 24. The at least one stopper 31 is a horizontal plate or a shaft to stop the head portion, an extension or the gripping portion of the second tool 52. In addition, between each fixer 30 and the at least one display zone 24 are defined at least one connector and at least one coupling portion for mating with the connector, such that each fixer 30 is mounted in the at least one display zone 24. In this embodiment, each fixer 30 is trapezoidal and includes a stopper 31 for stopping the second tool 52. Each fixer 30 further includes two wings 32, and each wing 32 extends downwardly from each of two ends of the stopper 31 and has a connector 33 (such as a bolt).

The at least one display zone 24 of the body 20 further includes two coupling portions 245. Each coupling portion 245 is an orifice corresponding to the connector 33 of each wing 32 of each fixer 30, such that the connector 33 inserts into each coupling portion 245. The stopper 31 of each fixer 30 extends across the protrusion 241 of the at least one display zone 24 and is located above the second tool 52. The connector 33 inserts into each coupling portion 245 to position each fixer 30 in the at least one display zone 24, and the stopper 31 stops the second tool 52, such that the second tool 52 is not stolen.

The at least one cover 40 is rotatably connected with the body 20. In this embodiment, between the at least one cover 40 and a second end of the body 20 are defined at least one connection stem and at least one coupling hole for mating with the at least one connection stem. In this embodiment, the body 20 further includes two coupling holes 25 arranged on the second end thereof, and the at least one cover 40 includes two connection stems 41 formed on a first end thereof. Each of the two connection stems 41 rotatably connects with each of the two coupling holes 25, such that the at least one cover 40 is rotatably connected with the body 20.

The at least one cover 40 also includes at least one second accommodating portion defined therein to accommodate the plural first tools 51. In this embodiment, the at least one cover 40 includes a plurality of second accommodating portions 42 defined therein to accommodate the plural first tools 51. The at least one cover 40 further includes at least one receiving groove formed therein and corresponding to the at least one display zone 24 of the body 20. When the at least one cover 40 covers the body 20, the second tool 52 is exposed in the at least one display zone 24 of the body 20. In addition, the at least one receiving groove is a recess, a plane or an aperture. In this embodiment, the at least one cover 40 includes a receiving groove 43 formed therein and corresponding to the at least one display zone 24 of the body 20. Thus, when the at least one cover 40 covers the body 20, the second tool 52 is exposed in the at least one display zone 24 of the body 20 by using the at least one receiving groove 43.

The at least one cover 40 further includes at least one stopping portion arranged therein and corresponding to each fixer 30 to avoid a removal of each fixer 30. In this embodiment, the at least cover 40 includes two stopping portions 44 arranged therein, and each stopping portion 44 corresponds to each wing 32 of each fixer 30, such that the two wings 32 of each fixer 30 are stopped by the two stopping portions 44. Furthermore, the at least one cover 40 further includes two fastening portions 45, and each fastening portion 45 corresponds to each of the two retainers 22 of the body 20, such that the two retainers 22 retain the at least one cover 40 and the body 20.

Referring to FIGS. 3 to 7, the tool box accommodates the plural first tools 51 and the second tool 52, and the at least one cover 40 is rotated inwardly along the two coupling holes 25 of the body 20 by using the two connection stems 41, so that the at least one cover 40 covers the body 20. Since the receiving groove 43 of the at least one cover 40 does not shield the at least one display zone 24 of the body 20, the second tool 52 in the at least one display zone 24 is exposed for visible purposes. The stopper 31 of each fixer 30 extends across the protrusion 241 of the at least one display zone 24 and is located above the second tool 52, and the two wings 32 of each fixer 30 are stopped by the two stopping portions 44 of the at least one cover 40, so each fixer 30 is not removed and positions the second tool 52 securely. In addition, after the at least one cover 40 covers the body 20, the two fastening portions 45 retain the two retainers 22 of the body 20, thus fixing the at least one cover 40 with the body 20.

Figure 8:
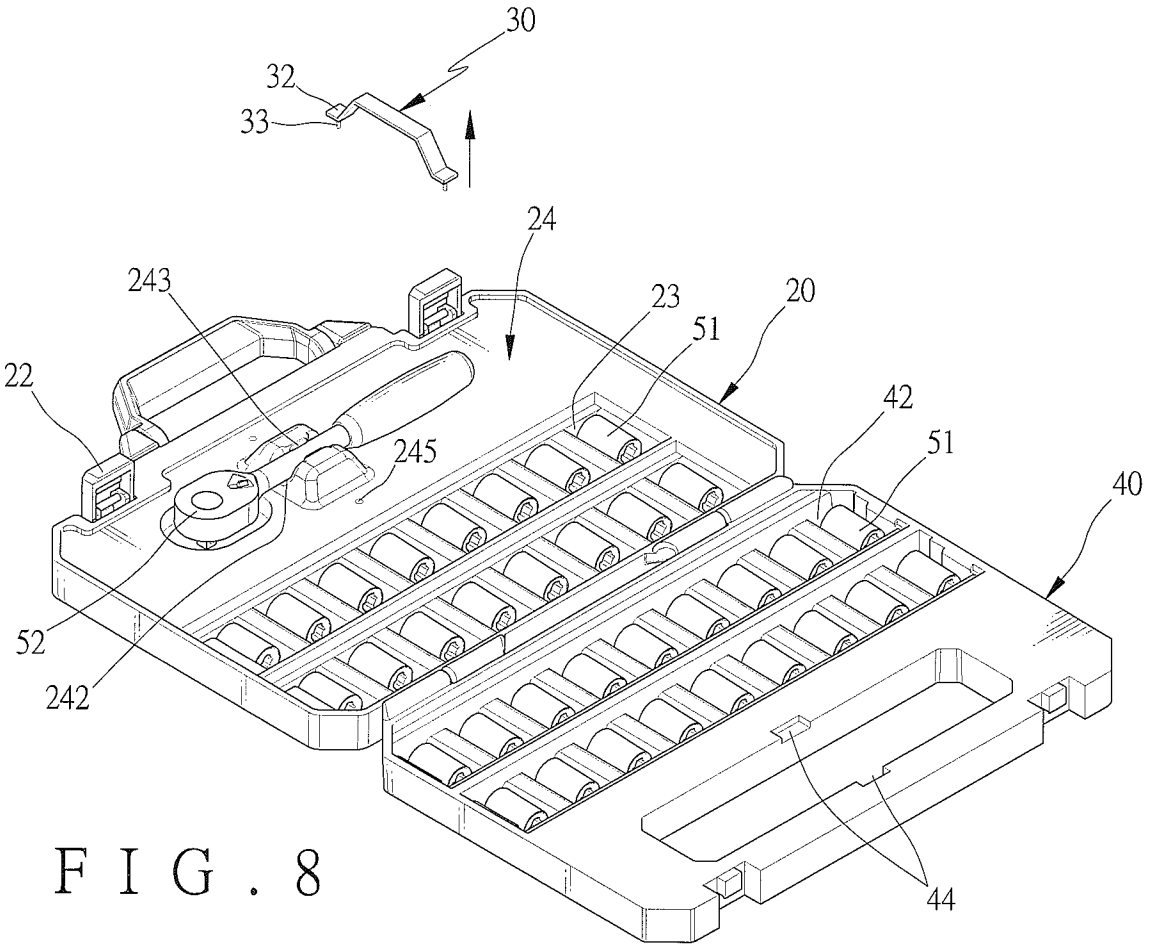
FIG. 8 is a perspective view showing the operation of the box tool according to the preferred embodiment of the present invention.
Figure 9:
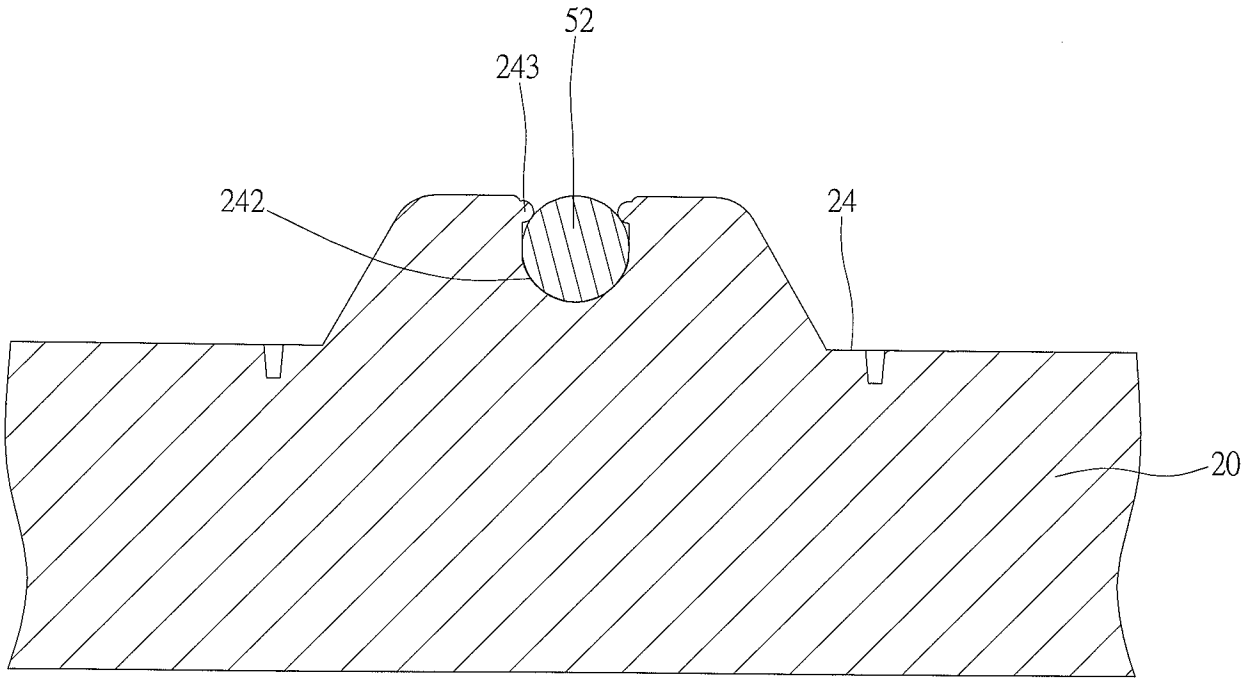
FIG. 9 is a cross sectional view of a part of FIG. 8.
Figure 10:
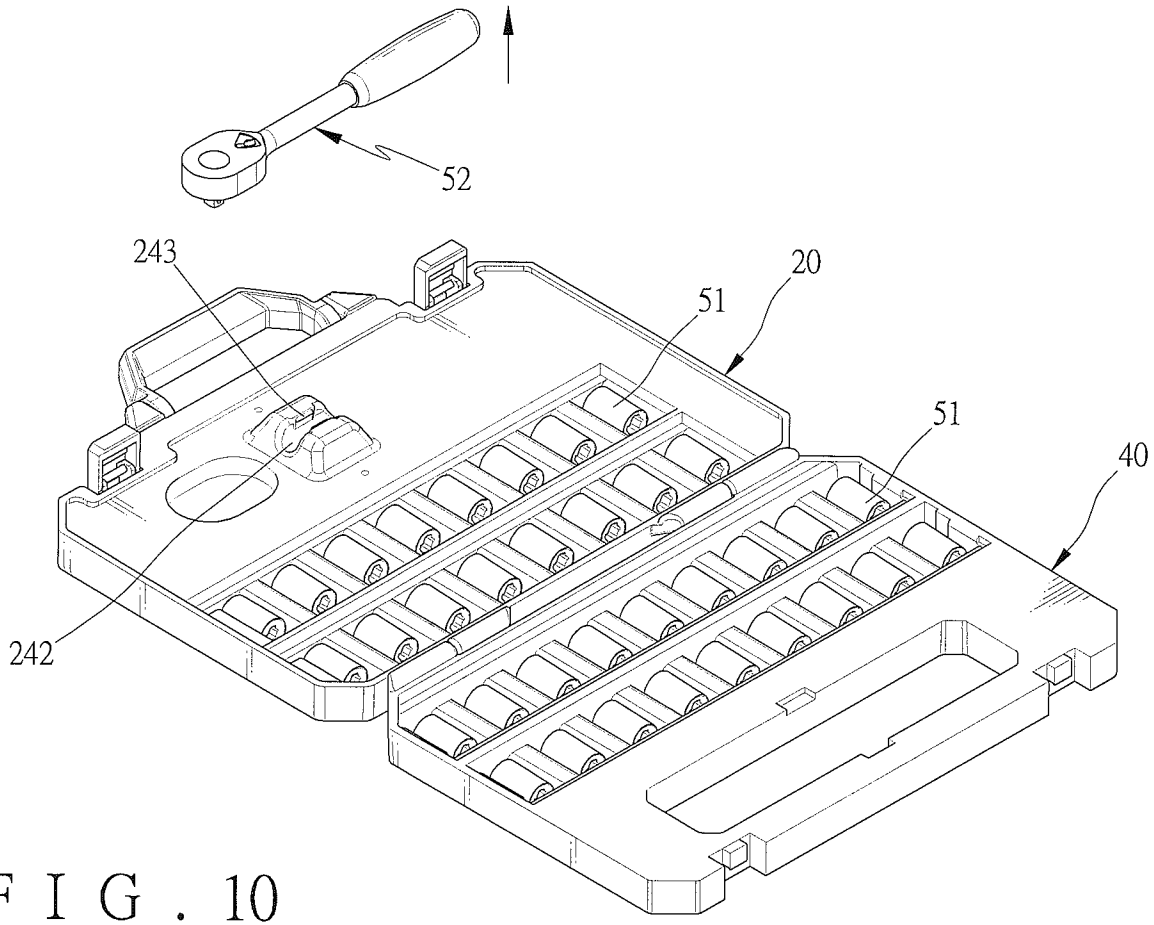
FIG. 10 is another perspective view showing the operation of the box tool according to the preferred embodiment of the present invention.

As shown in FIGS. 8 to 10, after removing the two retainers 22 from the at least one cover 40 and rotating the at least one cover 40 outwardly, the plural first tools 51 are removed from the plurality of first accommodating portions 23 and the plurality of second accommodating portions 42. Since the two stopping portions 44 move away from the two wings 32 of each fixer 30, each fixer 30 is removed upwardly so that the connector 33 moves away from each coupling portion 245. Preferably, each locking tab 243 retains with the second tool 52, and the second tool 52 does not move from the concave holding portion 242 of the body 20. When desiring to take the second tool 52, the second tool 52 is pulled upwardly to disengage from each locking tab 243, thus removing the second tool 52 from the concave holding portion 242 of the body 20.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A tool box comprising:

a body including a first accommodating portion for accommodating plural first tools, with the body also including a display zone in which a holding portion is defined to hold a second tool;

a fixer disposed in the display zone of the body, with the holding portion located intermediate the display zone and the fixer, with the fixer including a stopper to fix the second tool in the holding portion of the display zone;

a cover movable between a closed position and an open position and covering the first accommodating portion and the body, with the cover including a receiving groove formed therein and corresponding to the display zone of the body in the closed position to expose the display zone and the second tool in the display zone of the body with the cover in the closed position, with the stopper extending into the receiving groove and accessible through the receiving groove when the cover covers the accommodating portion and the body.

2. The tool box as claimed in claim 1, wherein the display zone of the body has a protrusion, a concave holding portion defined on the protrusion to hold the second tool, and two locking tabs, wherein each locking tab is formed on each of two side walls of the concave holding portion to retain the second tool.

3. The tool box as claimed in claim 1, wherein the at least one display zone of the body further includes a trench defined beside at least one of two sides of the concave holding portion to accommodate portion of the second tool.

4. The tool box as claimed in claim 1, wherein between the fixer and the display zone of the body are defined a connector and a coupling portion for mating with the connector.

5. The tool box as claimed in claim 4, wherein: the fixer further includes two wings, each wing extends downwardly from each of two ends of the stopper and has a connector, the display zone of the body further includes two coupling portions, and each coupling portion corresponds to the connector of each wing of the fixer.

6. The tool box as claimed in claim 1, wherein the cover includes a stopping portion arranged therein and moveable with the cover between the closed position and the open position and abutting with the fixer to stop the fixer when the cover covers the first accommodating portion and the body in the closed position.

7. The tool box as claimed in claim 1, wherein the receiving groove is any one of a recess, a plane, and an aperture.

8. The tool box as claimed in claim 1, wherein between the cover and one end of the body are defined a connection stem and a coupling hole for mating with the connection stem, and the cover is rotatably connected with the one end of the body.

9. The tool box as claimed in claim 1, wherein the body further includes a grip bar disposed on an end thereof and includes a retainer, and the cover further includes a fastening portion corresponding to the retainer of the body.

* * * * *